US008177148B1

(12) United States Patent
Renquist et al.

(10) Patent No.: US 8,177,148 B1
(45) Date of Patent: May 15, 2012

(54) IRRIGATION SPRINKLER WITH ADJUSTABLE NOZZLE TRAJECTORY

(75) Inventors: Steven C. Renquist, Chino Hills, CA (US); James T. Wright, III, Moreno Valley, CA (US); Miguel A. Santiago, Claremont, CA (US)

(73) Assignee: The Toro Company, Bloomington, MN (US)

( * ) Notice: Subject to any disclaimer, the term of this patent is extended or adjusted under 35 U.S.C. 154(b) by 26 days.

(21) Appl. No.: 11/673,453

(22) Filed: Feb. 9, 2007

Related U.S. Application Data

(60) Provisional application No. 60/772,498, filed on Feb. 10, 2006.

(51) Int. Cl.
*B05B 15/08* (2006.01)

(52) U.S. Cl. ..... 239/587.1; 239/237; 239/240; 239/204; 239/203; 239/225.1; 239/200; 239/206; 239/587.5; 239/393

(58) Field of Classification Search ..... 239/587.1, 239/587.5, 200, 204, 203, 201, 207, 256, 239/84, 282, 225.1, 393, 394, 596, 597, 598, 239/599, 602, DIG. 1, DIG. 15
See application file for complete search history.

(56) References Cited

U.S. PATENT DOCUMENTS

| | | | | |
|---|---|---|---|---|
| 755,995 | A | 3/1904 | Brown | |
| 1,146,394 | A | 7/1915 | Best | |
| 1,395,442 | A | 11/1921 | MacGregor | |
| 1,731,813 | A | 5/1927 | Bloom | |
| 1,667,943 | A | 5/1928 | Munz | |
| 2,083,282 | A | 6/1937 | Thompson | |
| 2,086,074 | A | 7/1937 | Genovese | |
| 2,295,880 | A | 9/1942 | Valois et al. | |
| 2,305,210 | A | 12/1942 | Wahlin | |
| 2,639,941 | A | 5/1953 | Glynn | |
| 2,709,623 | A | 5/1955 | Glynn | |
| 2,981,483 | A | 4/1961 | Pichon | |
| 3,054,563 | A | 9/1962 | Steinen | |
| 3,149,784 | A | 9/1964 | Skidgel | |
| 3,193,203 | A | 7/1965 | Crow | |
| 3,266,737 | A * | 8/1966 | Nees | 239/548 |
| 3,275,248 | A | 9/1966 | O'Brien et al. | |
| 3,362,641 | A | 1/1968 | Barnes | |
| 3,428,256 | A | 2/1969 | Painter | |

(Continued)

FOREIGN PATENT DOCUMENTS

DE 765 232 8/1954

(Continued)

OTHER PUBLICATIONS

United States Patent and Trademark Office, Office Action mailed Dec. 23, 2010 in U.S. Appl. No. 11/625,776, 11 pages.

(Continued)

*Primary Examiner* — Len Tran
*Assistant Examiner* — Trevor E McGraw
(74) *Attorney, Agent, or Firm* — Inskeep IP Group, Inc.

(57) ABSTRACT

One embodiment provides an asymmetrical nozzle housing within a nozzle base of a sprinkler which, when rotated, changes its angular orientation relative to the nozzle base. Since the nozzle is disposed within the nozzle housing, it similarly changes angular orientation relative to the nozzle base, thereby modifying the trajectory of ejected water during irrigation. In this respect, a user can change the trajectory of a watering stream by simply rotating the nozzle housing.

20 Claims, 13 Drawing Sheets

U.S. PATENT DOCUMENTS

| | | | | | |
|---|---|---|---|---|---|
| 3,645,451 | A | | 2/1972 | Hauser | |
| 3,655,132 | A | | 4/1972 | Rosic | |
| 3,702,678 | A | | 11/1972 | Hauser | |
| 3,713,584 | A | * | 1/1973 | Hunter | 239/206 |
| 3,716,192 | A | | 2/1973 | Hunter | |
| 3,794,245 | A | | 2/1974 | Wilson | |
| 3,920,187 | A | | 11/1975 | Willis | |
| 3,921,912 | A | | 11/1975 | Hayes | |
| 3,955,764 | A | | 5/1976 | Phaup | |
| 4,269,354 | A | | 5/1981 | DeWitt | |
| 4,498,626 | A | | 2/1985 | Pitchford | |
| 4,540,125 | A | * | 9/1985 | Gorney et al. | 239/232 |
| 4,671,462 | A | * | 6/1987 | Badria | 239/227 |
| 4,867,378 | A | | 9/1989 | Kah, Jr. | |
| 4,892,252 | A | | 1/1990 | Bruninga | |
| 4,901,924 | A | | 2/1990 | Kah, Jr. | |
| 4,971,256 | A | | 11/1990 | Malcolm | |
| 5,048,757 | A | | 9/1991 | Van Leeuwen | |
| 5,104,045 | A | * | 4/1992 | Kah, Jr. | 239/246 |
| 5,141,157 | A | | 8/1992 | Han et al. | |
| 5,234,169 | A | | 8/1993 | McKenzie | |
| 5,240,182 | A | * | 8/1993 | Lemme | 239/205 |
| 5,240,184 | A | * | 8/1993 | Lawson | 239/499 |
| 5,292,071 | A | | 3/1994 | Kruer | |
| 5,299,742 | A | * | 4/1994 | Han | 239/206 |
| 5,377,914 | A | * | 1/1995 | Christen | 239/252 |
| 5,456,411 | A | * | 10/1995 | Scott et al. | 239/73 |
| 5,526,982 | A | | 6/1996 | McKenzie | |
| 5,598,977 | A | | 2/1997 | Lemme | |
| 5,642,861 | A | | 7/1997 | Ogi et al. | |
| 5,695,123 | A | | 12/1997 | Le | |
| 5,722,593 | A | | 3/1998 | McKenzie | |
| 5,810,259 | A | | 9/1998 | Sinclair | |
| 5,823,439 | A | * | 10/1998 | Hunter et al. | 239/205 |
| 5,823,440 | A | * | 10/1998 | Clark | 239/206 |
| 5,868,316 | A | | 2/1999 | Scott | |
| 5,918,812 | A | * | 7/1999 | Beutler | 239/205 |
| 5,975,430 | A | | 11/1999 | Larsen | |
| 6,029,907 | A | | 2/2000 | McKenzie | |
| 6,050,502 | A | * | 4/2000 | Clark | 239/237 |
| 6,085,995 | A | * | 7/2000 | Kah et al. | 239/237 |
| 6,126,093 | A | | 10/2000 | Grether et al. | |
| 6,145,758 | A | * | 11/2000 | Ogi et al. | 239/457 |
| 6,332,581 | B1 | * | 12/2001 | Chin et al. | 239/246 |
| 6,499,678 | B1 | * | 12/2002 | Hope | 239/581.1 |
| 6,732,950 | B2 | | 5/2004 | Ingham, Jr. et al. | |
| 6,732,952 | B2 | * | 5/2004 | Kah, Jr. | 239/225.1 |
| 6,820,825 | B1 | * | 11/2004 | Wang | 239/457 |
| 6,923,383 | B1 | | 8/2005 | Joshi et al. | |
| 6,945,471 | B2 | | 9/2005 | McKenzie et al. | |
| 7,017,831 | B2 | * | 3/2006 | Santiago et al. | 239/222.13 |
| 7,325,753 | B2 | * | 2/2008 | Gregory et al. | 239/522 |
| 2003/0218082 | A1 | | 11/2003 | Malcolm | |
| 2005/0023378 | A1 | * | 2/2005 | Gregory et al. | 239/522 |
| 2005/0167526 | A1 | * | 8/2005 | McKenzie et al. | 239/225.1 |
| 2005/0211805 | A1 | * | 9/2005 | Eddins et al. | 239/589 |
| 2005/0284956 | A1 | | 12/2005 | Mast | |

FOREIGN PATENT DOCUMENTS

| | | |
|---|---|---|
| GB | 14724 | 10/1908 |
| GB | 161937 | 6/1992 |

OTHER PUBLICATIONS

United States Patent and Trademark Office, Final Office Action mailed Jun. 25, 2010 in U.S. Appl. No. 11/625,776, 10 pages.
United States Patent and Trademark Office, Final Office Action mailed Jun. 23, 2009 in U.S. Appl. No. 11/625,776, 10 pages.
United States Patent and Trademark Office, Office Action mailed Dec. 22, 2008 in U.S. Appl. No. 11/625,776, 8 pages.
United States Patent and Trademark Office, Notice of Allowance mailed Mar. 20, 2008 in U.S. Appl. No. 11/253,775, 4 pages.
United States Patent and Trademark Office, Office Action mailed Dec. 7, 2007 in U.S. Appl. No. 11/253,775, 5 pages.
United States Patent and Trademark Office, Final Office Action mailed Jul. 16, 2007 in U.S. Appl. No. 11/253,775, 6 pages.
United States Patent and Trademark Office, Final Office Action mailed Oct. 12, 2006 in U.S. Appl. No. 10/957,963, 6 pages.
United States Patent and Trademark Office, Office Action mailed May 10, 2006 in U.S. Appl. No. 10/957,963, 6 pages.
United States Patent and Trademark Office, Notice of Allowance mailed Apr. 4, 2006 in U.S. Appl. No. 10/713,334, 7 pages.
United States Patent and Trademark Office, Office Action mailed Mar. 8, 2006 in U.S. Appl. No. 11/253,775, 8 pages.
United States Patent and Trademark Office, Office Action mailed Nov. 15, 2005 in U.S. Appl. No. 10/713,334, 9 pages.
United States Patent and Trademark Office, Office Action mailed Sep. 16, 2005 in U.S. Appl. No. 10/713,334, 5 pages.
United States Patent and Trademark Office, Office Action mailed Jan. 18, 2005 in U.S. Appl. No. 10/173,334, 6 pages.

* cited by examiner

IRRIGATION SPRINKLER WITH ADJUSTABLE NOZZLE TRAJECTORY

RELATED APPLICATIONS

This application claims priority to U.S. Provisional Application Ser. No. 60/772,498 filed Feb. 10, 2006 entitled IRRIGATION SPRINKLER WITH ADJUSTABLE NOZZLE TRAJECTORY and is hereby incorporated by reference.

BACKGROUND OF THE INVENTION

Sprinkler systems for turf irrigation are well known. Typical systems include a plurality of valves and sprinkler heads in fluid communication with a water source, and a centralized controller connected to the water valves. At appropriate times the controller opens the normally closed valves to allow water to flow from the water source to the sprinkler heads. Water then issues from the sprinkler heads in predetermined fashion.

There are many different types of sprinkler heads, including above-the-ground heads and "pop-up" heads. Pop-up sprinklers, though generally more complicated and expensive than other types of sprinklers, are thought to be superior. There are several reasons for this. For example, a pop-up sprinkler's nozzle opening is typically covered when the sprinkler is not in use and is therefore less likely to be partially or completely plugged by debris or insects. Also, when not being used, a pop-up sprinkler is entirely below the surface and out of the way.

The typical pop-up sprinkler head includes a stationary body and a "riser" which extends vertically upward, or "pops up," when water is allowed to flow to the sprinkler. The riser is in the nature of a hollow tube which supports a nozzle at its upper end. When the normally-closed valve associated with a sprinkler opens to allow water to flow to the sprinkler, two things happen: (i) water pressure pushes against the riser to move it from its retracted to its fully extended position, and (ii) water flows axially upward through the riser, and the nozzle receives the axial flow from the riser and turns it radially to create a radial stream. A spring or other type of resilient element is interposed between the body and the riser to continuously urge the riser toward its retracted, subsurface, position, so that when water pressure is removed the riser assembly will immediately return to its retracted position.

The riser assembly of a pop-up or above-the-ground sprinkler head can remain rotationally stationary or can include a portion that rotates in continuous or oscillatory fashion to water a circular or partly circular area, respectively. More specifically, the riser assembly of the typical rotary sprinkler includes a first portion (e.g. the riser), which does not rotate, and a second portion, (e.g., the nozzle assembly) which rotates relative to the first (non-rotating) portion.

The rotating portion of a rotary sprinkler riser typically carries a nozzle at its uppermost end. The nozzle throws at least one water stream outwardly to one side of the nozzle assembly. As the nozzle assembly rotates, the water stream travels or sweeps over the ground, creating a watering arc.

The trajectory of the watering stream is determined by the angle and shape of the nozzle within the nozzle assembly. In many prior art sprinklers, the trajectory of the watering stream is predetermined by the sprinkler manufacturer, often to achieve a maximum throw distance. However, these sprinklers prevent the user from modifying or otherwise adjusting the radius of these watering arcs (i.e. the length of the water stream), thereby limiting the ability to control and distribute water.

Other prior art sprinklers allow the user to change the trajectory of the watering stream by providing replacement nozzles that cause alternate, predetermined trajectories. However, the user must determine the exact size of the desired watering arc radius, then install a new nozzle rated for that distance. Thus the user is burdened with the added hassle of installing a new nozzle or nozzle base.

Newer prior art sprinklers, such as those seen in U.S. Pat. No. 6,869,026 (incorporated herein by reference), include a pivot mounted nozzle configured to follow a worm gear. A user rotates the worm gear from a screw mounted at the top of the sprinkler which causes the nozzle to change its trajectory. While these nozzle designs can achieve a variety of different nozzle angles, their additional components and complexity increase the cost to manufacture the sprinkler.

What is needed is a nozzle adjustment mechanism for a sprinkler that is simple to adjust, does not require added user expense to adjust, and does not significantly increase manufacturing costs.

OBJECTS AND SUMMARY OF THE INVENTION

It is an object of the present invention to overcome the limitations of the prior art.

It is another object of the present invention to provide an improved nozzle adjustment mechanism for an irrigation sprinkler.

It is a further object of the present invention to provide a nozzle adjustment mechanism that allows a user to more easily adjust a sprinkler nozzle to a desired position.

It is another object of the present invention to provide a nozzle adjustment mechanism that does not require the user to purchase additional components.

It is yet another object of the present invention to provide a nozzle adjustment mechanism that does not significantly increase the cost of sprinkler manufacturing.

The present invention seeks to achieve these objects in at least one embodiment by providing an asymmetrical nozzle housing within a nozzle base of a sprinkler which, when rotated, changes its angular orientation relative to the nozzle base. Since the nozzle is disposed within the nozzle housing, it similarly changes angular orientation relative to the nozzle base, thereby modifying the trajectory of ejected water during irrigation. In this respect, a user can change the trajectory of a watering stream by simply rotating the nozzle housing.

DETAILED DESCRIPTION OF THE INVENTION

Figure 1:
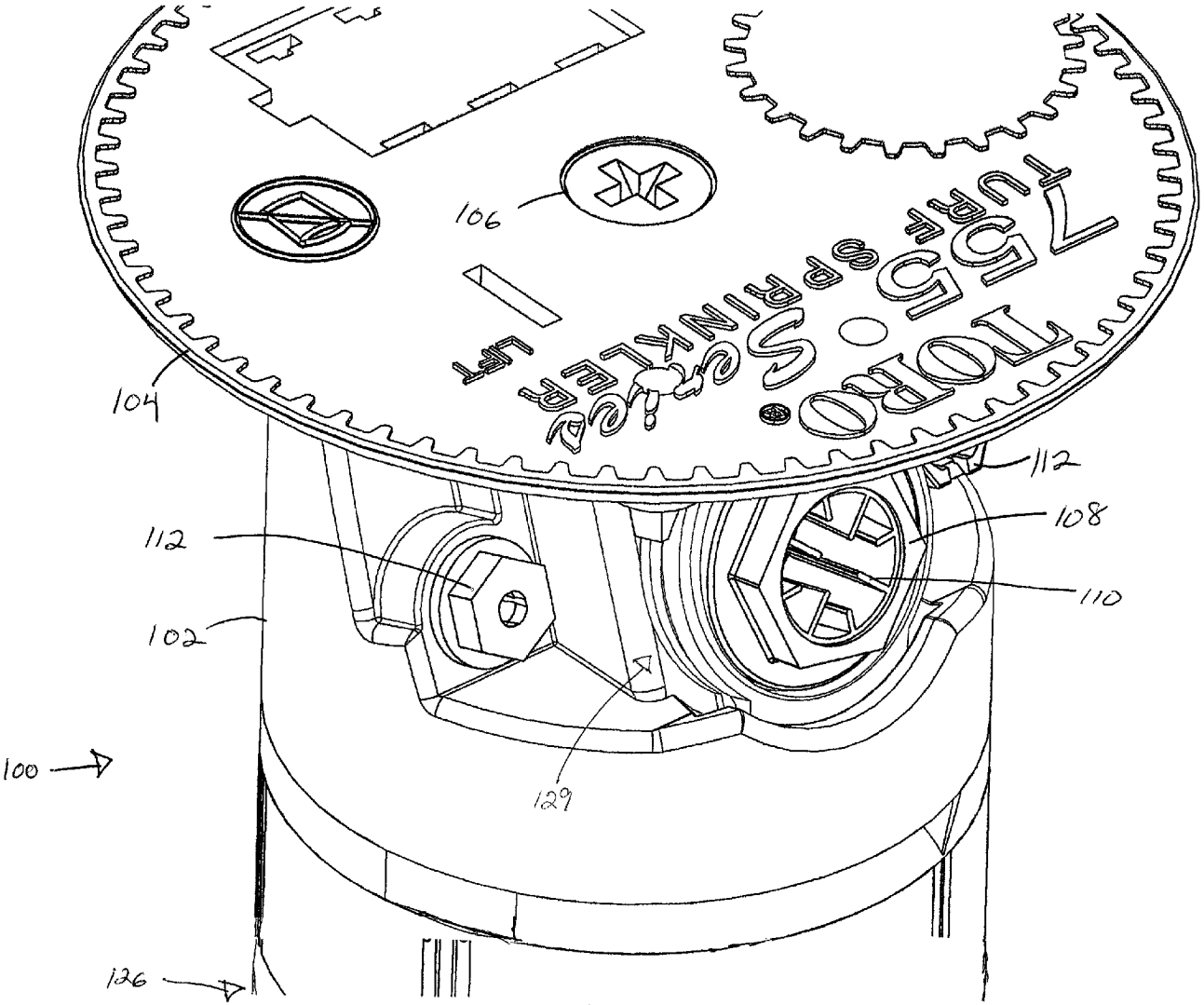
FIG. 1 illustrates a perspective view of a sprinkler according to the present invention.
Figure 2:
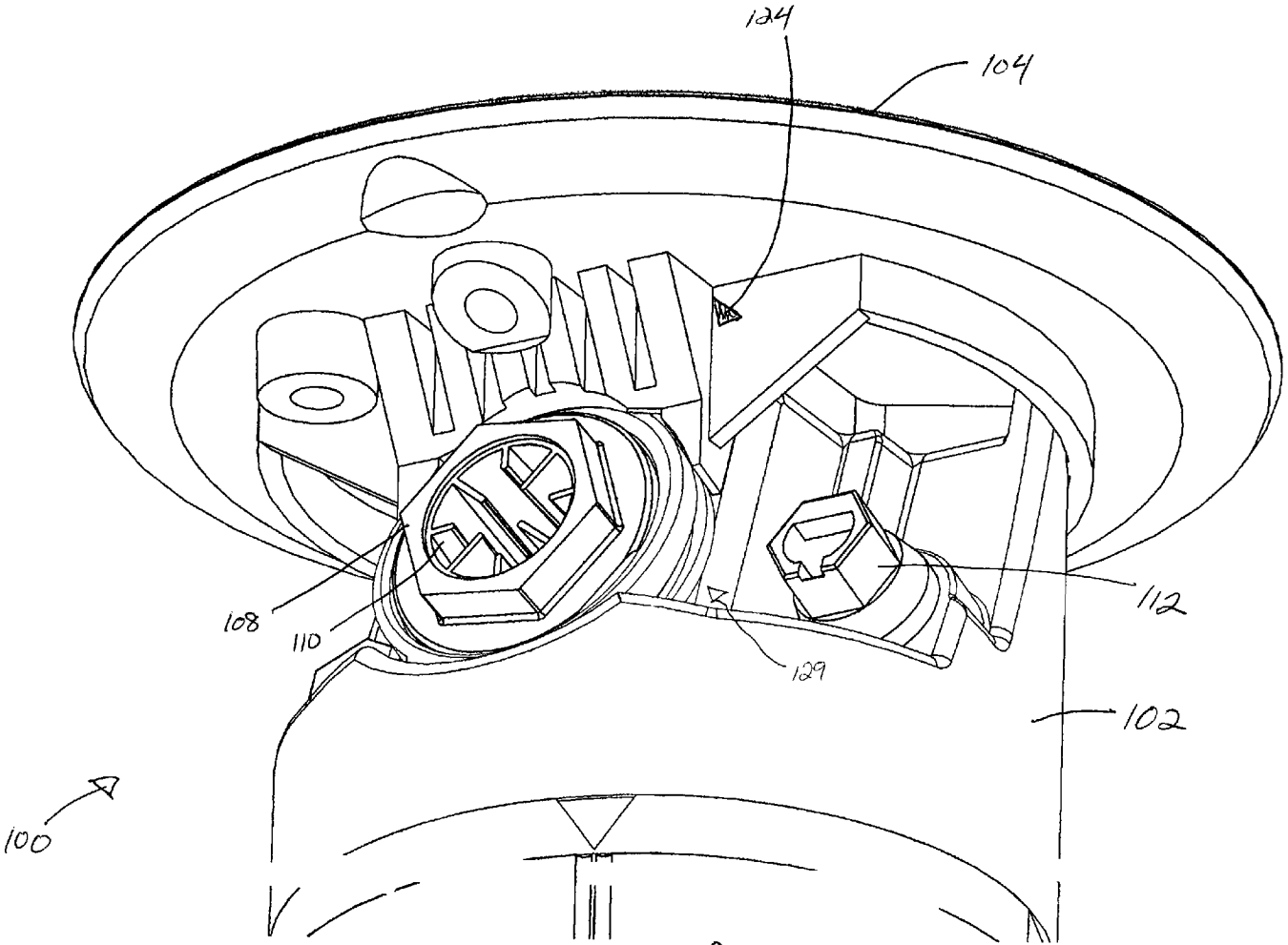
FIG. 2 illustrates a perspective view of the sprinkler of FIG. 1.
Figure 3:
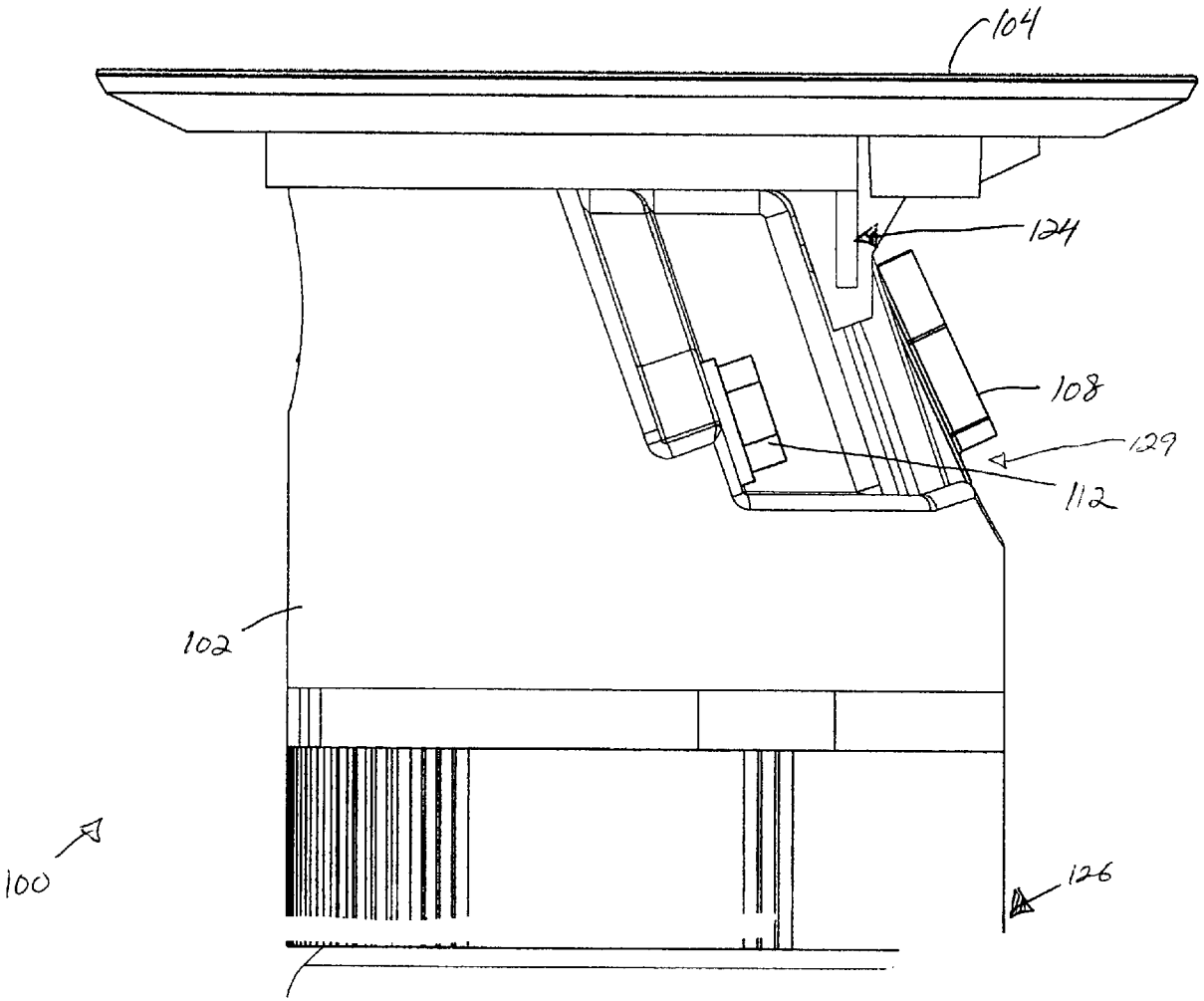
FIG. 3 illustrates a side profile view of the sprinkler of FIG. 1.

FIGS. 1-3 illustrate a preferred embodiment of a sprinkler 100 having an adjustable watering stream trajectory to increase or decrease the watering radius. More specifically, the position of a nozzle 108 can be adjusted within a nozzle base 102 to achieve various angular positions, thereby directing a watering stream away from the sprinkler 100 at different trajectories. As described in further detail below, the position of the nozzle 108, and therefore the trajectory of the watering stream, is removably secured in place by retaining ribs 124 of a sprinkler cap 104, allowing the user to easily adjust the trajectory of the nozzle 108 by removing the sprinkler top 104, then rotating the nozzle housing 120 which partially encloses the nozzle 108 to achieve a desired angle.

As seen in FIGS. 1-5, the sprinkler top 104 is molded to fit onto a top of the nozzle base 102, and is secured in place by a retaining screw 106. The nozzle base 102, in turn, is coupled to a riser 126 which, through the internal gearing of the riser, causes the nozzle base 102 to rotate in a full circle or according to user-defined arc limits.

Figure 10:
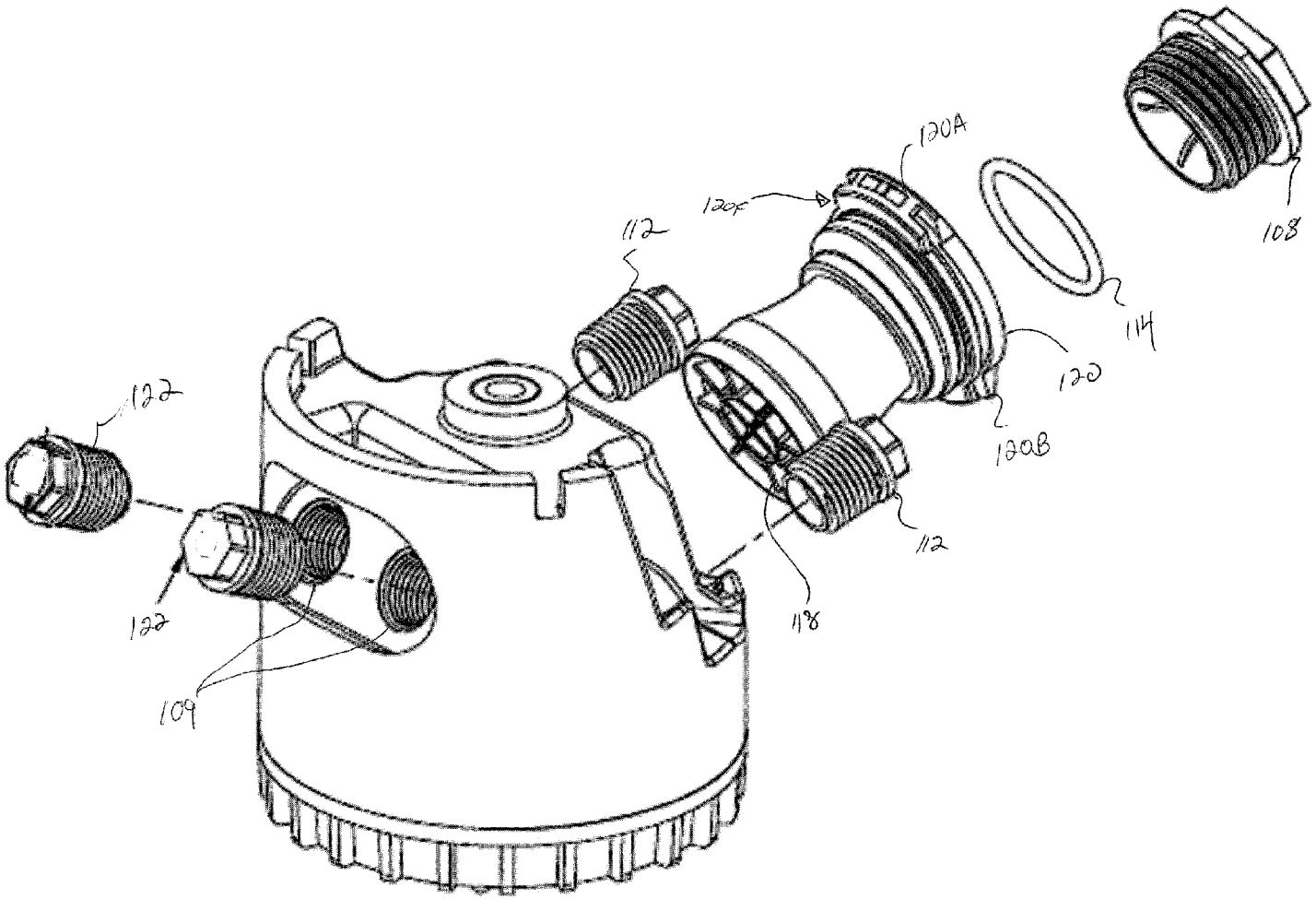
FIG. 10 illustrates an exploded perspective view of the sprinkler of FIG. 1.

Optionally, the nozzle base 108 of the present preferred embodiment includes two secondary nozzles 112 positioned on either side of the nozzle 108. Since the nozzle 108 may distribute water unevenly to areas within a watering arc, for example, within close proximity to the sprinkler 100, the secondary nozzles 112 are positioned to distribute additional water to less watered areas to "even out" the water distribution. As seen in FIG. 10, these secondary nozzles 112 can be removed and replaced with plugs 122. In turn, the removed secondary nozzles 112 can be positioned in rear apertures 109 as shown in FIG. 10 for providing additional watering nozzles, especially for watering in a full circle. Additionally, the rear apertures can be used at the discretion of the user to irrigate landscape that is opposite of the user defined watering arc. Such a configuration can be especially useful, for example, when the sprinkler 100 is located on the transition between the fairway and the rough of a golf course, providing different amounts of water to each area at the same time.

As seen best in FIGS. 6, 7, 9 and 10 the nozzle 108 couples to the nozzle housing 120 by mating screw threads on the surfaces of both elements. Once coupled, the nozzle 108 and the nozzle housing 120 create a single flow passage 131 containing a flow straightener 118 and straightening vanes 110. This flow passage 131 continues through the nozzle base 102 as a passage for water, providing an exit for the pressurized water within the sprinkler 100 during irrigation, as well as a region to straighten and otherwise shape the outgoing water stream.

As explained below, the axis of the passage within the nozzle 108 is parallel to the axis of the passage of the nozzle housing 120 at all times (i.e. at all trajectory angles of the exit stream). Such parallel axes create an essentially straight flow path between the flow passage of the nozzle housing 120 and the nozzle 108, minimizing turbulence. This is especially the case when compared with a design where trajectory is changed by adjusting only the nozzle 108, which changes angles relative to the nozzle housing 120 to create a bent flow path between the two elements. By decreasing turbulence, this preferred embodiment of the present invention allows for relatively higher exit velocities and therefore greater water flow distances than prior art low angle nozzles.

To prevent unwanted leakage between the nozzle 108 and the nozzle housing 120 outside of the flow passage, an o-ring seal 114 is included at the interface between the two components. Similarly, the nozzle housing 120 also includes a second o-ring seal 116 which contacts the nozzle base 102 to prevent unwanted water leakage outside of the flow passage.

Figure 11C:
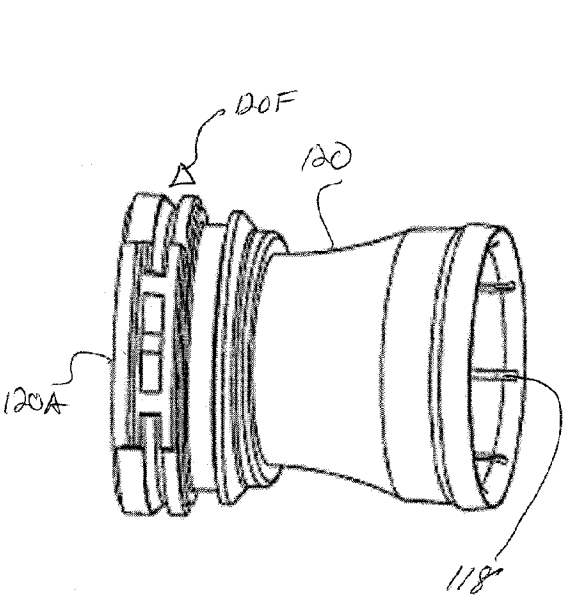
FIGS. 11A-11E illustrates various views of a nozzle housing according to the present invention.
Figure 11B:
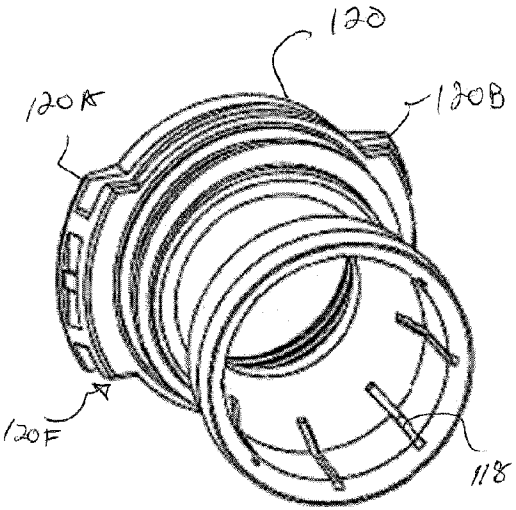
Figure 11A:
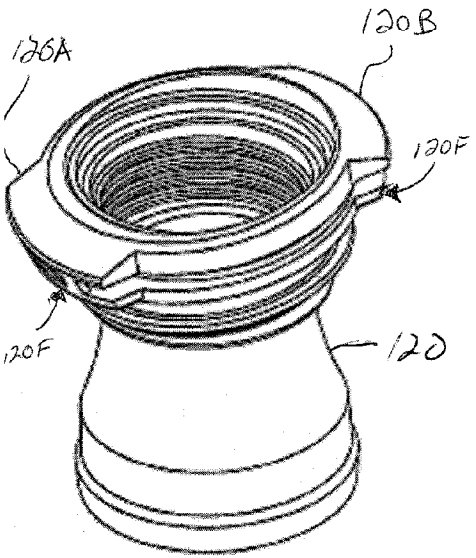
Figure 11D:
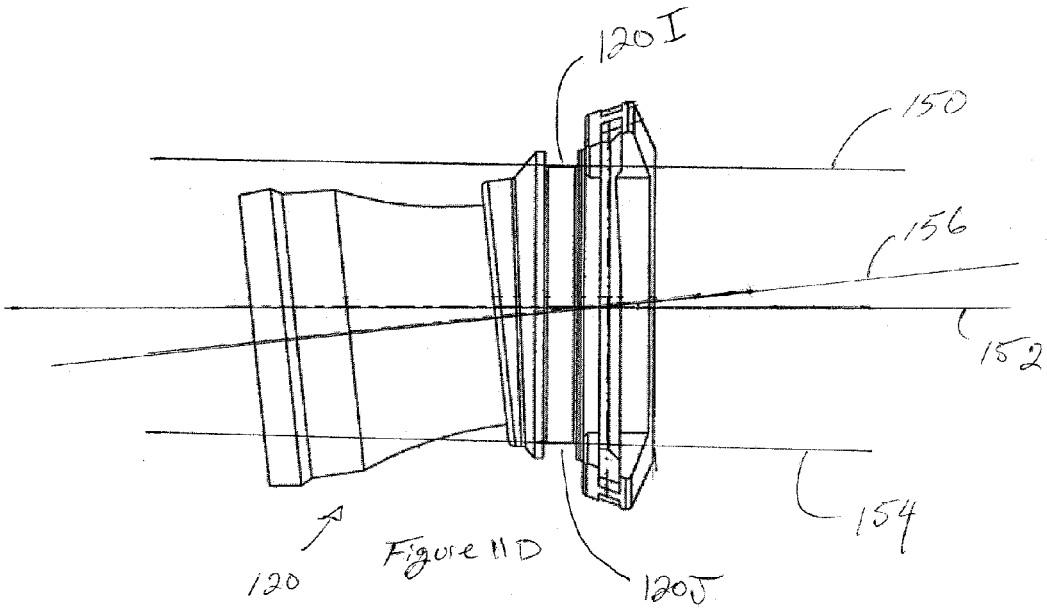

As seen in FIG. 11D, the nozzle housing 120 couples to the nozzle base 102 at two planes represented by parallel lines 150 and 154 at areas 1201 and 120J respectively. However, the axis 156 of the inner passage 131 does not follow the same relative angle of these planes 150 and 154. For comparative purposes, a line 152 parallel to lines 150 and 154 has been drawn over the passage axis 156 to better illustrate the different orientation of these lines.

Figure 11E:
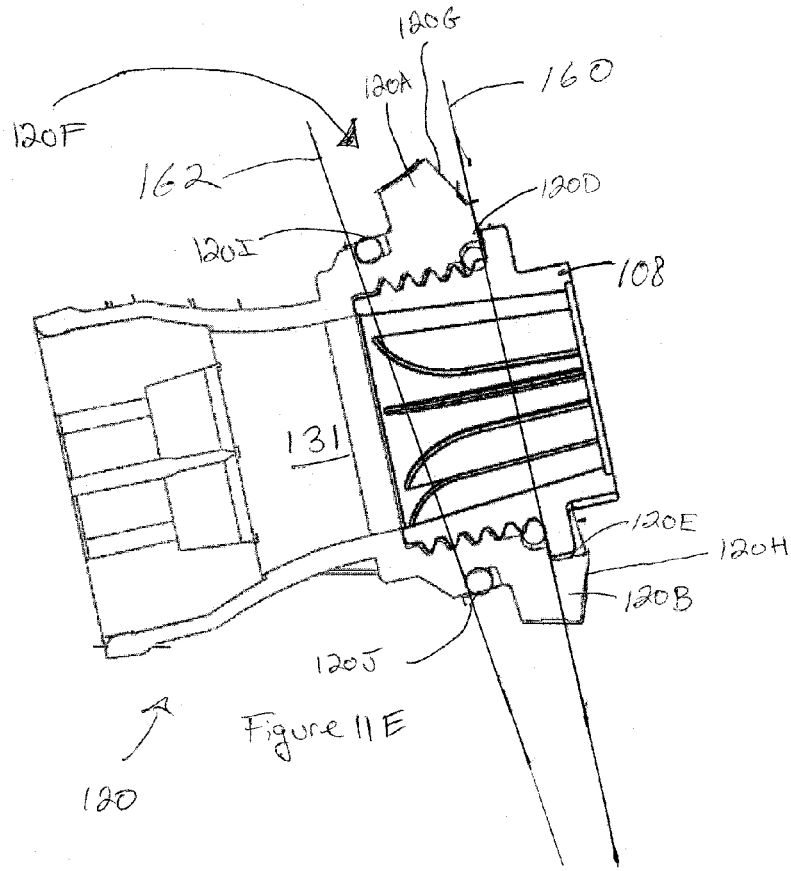

If the nozzle 108 was connected to the nozzle housing 120 along the planes 150 and 154, the inner flow passage 131 would bend at the nozzle 108, causing undesired flow characteristics. In order to maintain a straight flow passage 131 through the nozzle 108, the nozzle 108 couples into the nozzle housing 120 along a plane that matches the axis 156 of the flow passage 131 of the nozzle housing 120. Specifically, as seen in FIG. 11E, this is achieved by having a cylindrical mating feature formed by recessed area 120E and a non-recessed area 120D on the outer surface of the nozzle housing 120 at an angle to the interior flow axis 156.

Again for comparative purposes, a line 160 has been drawn between areas 120D and 120E where the nozzle 108 contacts the nozzle housing 120. Also, a line has been drawn between areas 120I and 120J where the nozzle housing 120 meets the nozzle base 102. As can be seen, these two lines 160 and 162 are not parallel, allowing the flow passage 131 to be straight, even through the inside of the nozzle 108. In other words, the nozzle housing 120 does not sit within the nozzle base 102 at the same angle as the flow passage 131.

Figure 4:
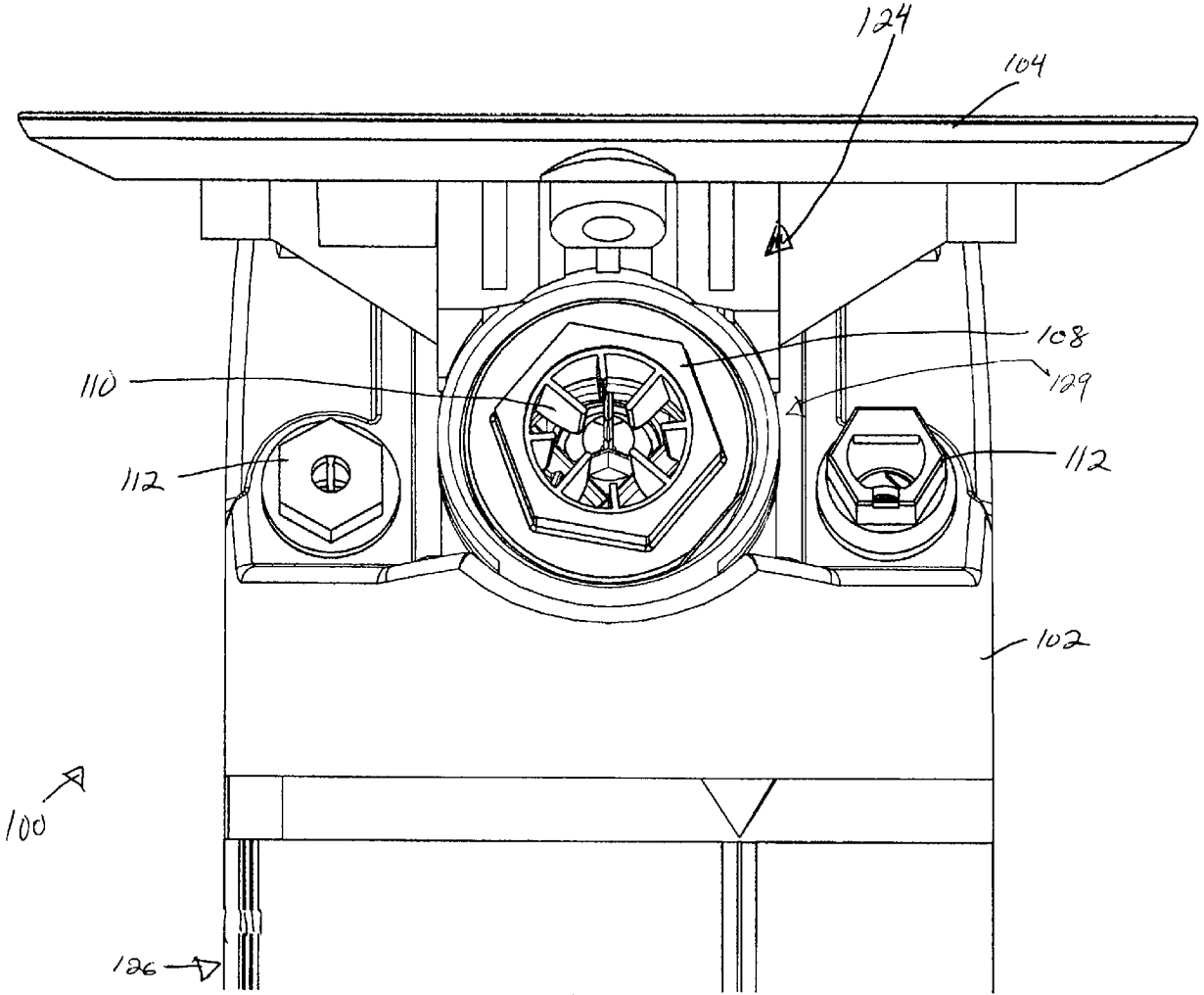
FIG. 4 illustrates a front view of the sprinkler of FIG. 1 in a lower angular position.
Figure 5:
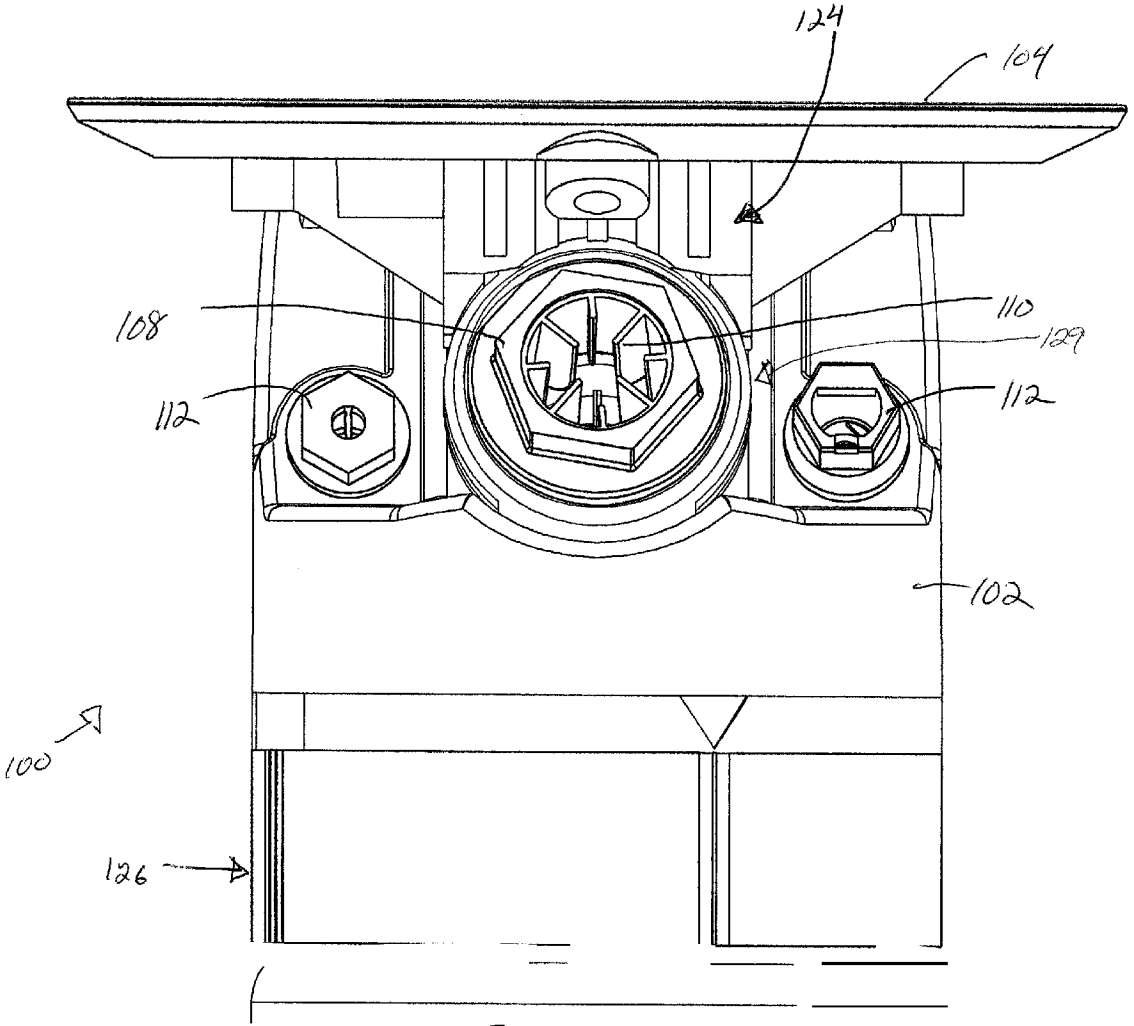
FIG. 5 illustrates a front view of the sprinkler of FIG. 1 in a higher angular position.

In a preferred embodiment of the present invention, the nozzle 110 can be locked into at least two angular positions: a lower angular position seen in FIG. 4 and a higher angular position seen in FIG. 5. The higher angular position directs water at a relatively higher trajectory and therefore a relatively longer distance than the lower angular position, allowing the user at least two different distances to which the watering stream can be directed.

Figure 6:
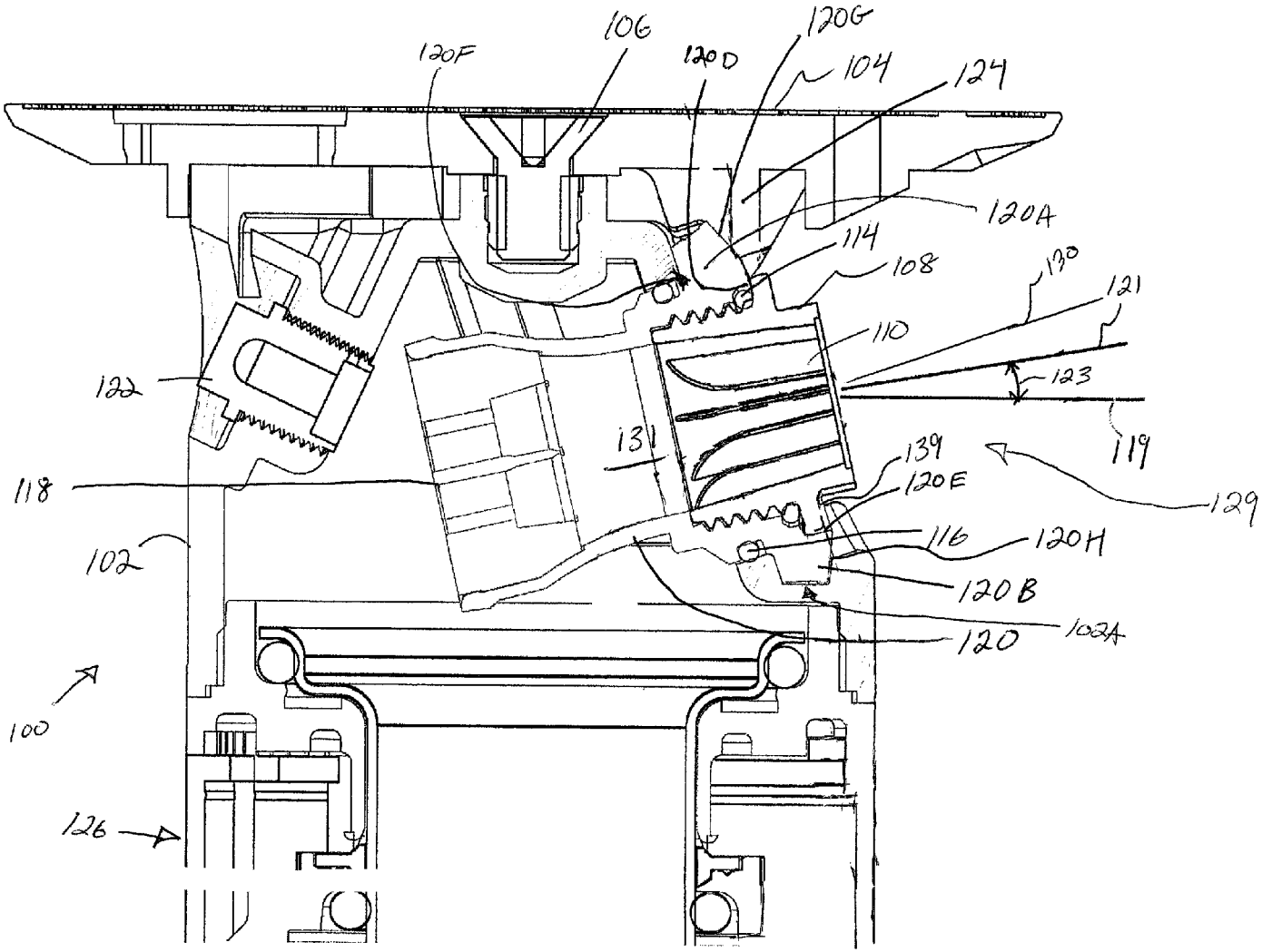
FIG. 6 illustrates a sectional side view of the sprinkler seen in FIG. 4 in a lower angular position.
Figure 7:
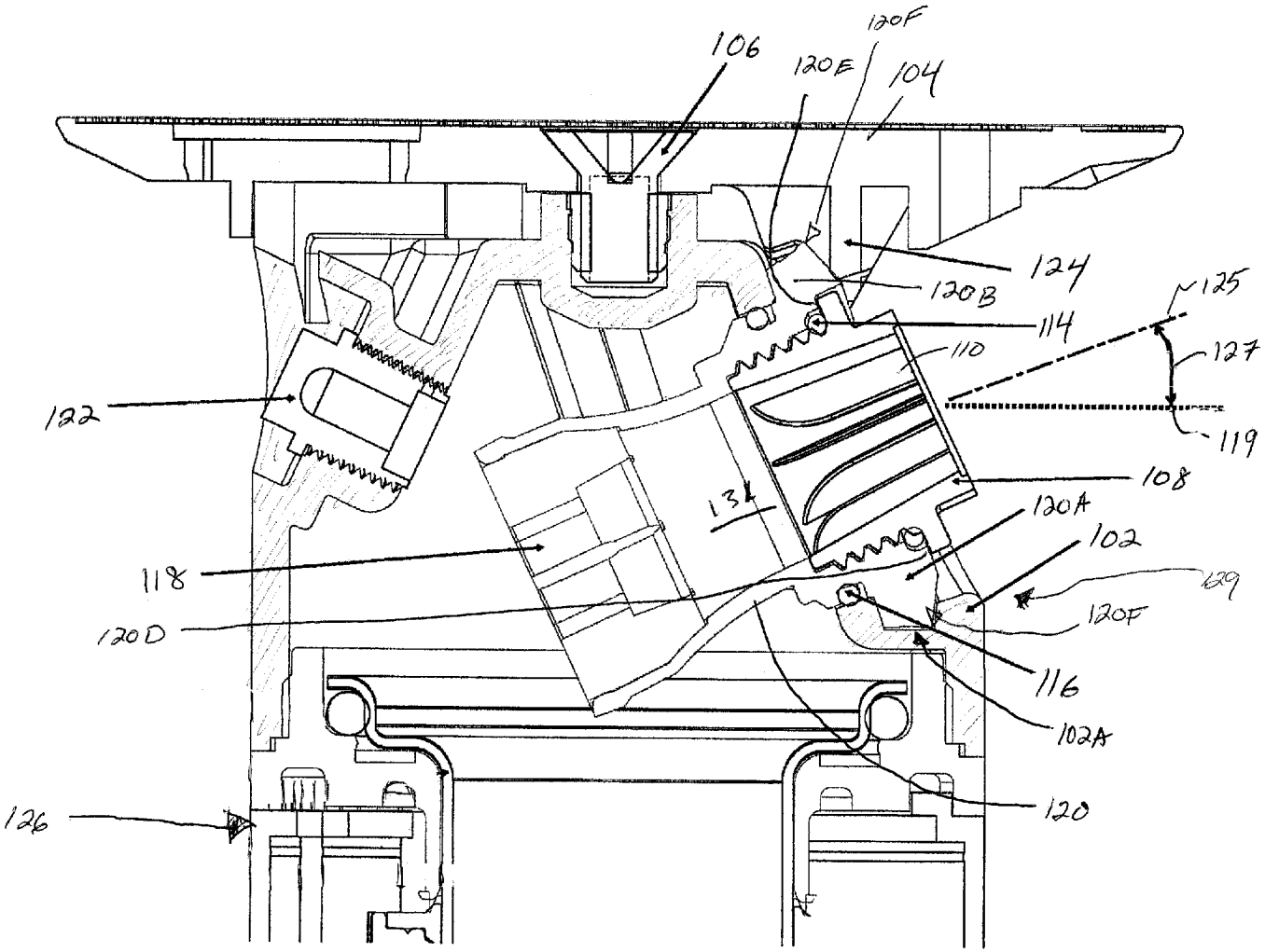
FIG. 7 illustrates a sectional side view of the sprinkler seen in FIG. 5 in a higher angular position.

As seen in the cross sectional views of FIGS. 6 and 7, the different angular positions of the nozzle 108 can be achieved with an asymmetrical or offset shape of a nozzle housing 120 which, when rotated, changes its angular orientation relative to the nozzle base 102. This asymmetry can best be seen by comparing a first lip area 120A with a second coupling lip area 120B. Since the nozzle 108 is disposed within the nozzle housing 120, it similarly changes angular orientation relative to the nozzle base 102, thereby modifying the trajectory of ejected water during irrigation. Additionally, the asymmetrical shape further augments the trajectory of the nozzle 108 created by the orientation of the nozzle 108 within the nozzle housing 120.

FIG. 11D also illustrates this concept. During rotation of the nozzle housing 120, planes 150 and 154 of areas 1201 and 120J respectively remain at the same angle relative to the nozzle base 102. However, the angle of the axis 156 of the flow passage 131 increases or decreases. In this respect, simply rotating the nozzle housing 120 adjusts the trajectory of the flow passage 131 within a predetermined range. This range is primarily determined by the difference between planes 150, 154 and the flow passage axis 156. The greater the difference between these lines, the greater the range of possible trajectories.

The nozzle housing 120 preferably includes a coupling lip 120F revolved about an axis represented by line 152 which is at an angle to the interior flow axis 156, as seen in FIG. 11D. This angle can be achieved by the coupling lip having areas of increased thickness, height, shape, or any combination of these characteristics around the outer circumference of the nozzle housing 120 for use in positioning the nozzle housing 120 in a desired orientation. Preferably this coupling lip 120F forms discrete areas of increased height and thickness, such as the first coupling lip area 120A and the second coupling lip area 120B as best seen in FIGS. 6, 7, 9, and 11A-11E. The first coupling lip 120A has an increased height and thickness over the second coupling lip 120B (i.e., a first height and thickness and a second height and thickness). Both coupling lip areas 120A and 120B include an inwardly angled outer surface 120G and 120H, however, the outer surface 120G of the first coupling lip area 120A is angled inwardly (i.e. towards the inside of the nozzle housing 102) to a greater degree than the outer surface 120H of the second coupling lip area 120B. Alternatively, the coupling lip areas may increase and decrease in height and thickness less abruptly, providing a range of possible positions for the nozzle housing 120.

Each area 120A and 120B of the coupling lip 120F is configured to fit within mating surfaces such as a groove 102A of the nozzle base 102, as well as between the ribs 124 of sprinkler cap 104 and an internal region of the nozzle base 102. Since both coupling lip areas 120A and 120B preferably have different thicknesses, heights, and surface shapes, the angular orientation of the nozzle housing 120 changes depending on the position of these mating surfaces (e.g., coupling lip areas 120A and 120B) within the nozzle housing 120, as shown and explained below.

For example, FIG. 6 illustrates the first coupling lip area 120A positioned near the ribs 124 while the second coupling lip area 120B is positioned within groove 102A. This orientation causes the trajectory along line 121 from the nozzle 108 to have an angle 123 from a horizontal plane 119 of the sprinkler body of about 12.5 degrees.

FIG. 7 illustrates a second example orientation where the first coupling lip area 120A is located within groove 102A and the second coupling lip area 120B is positioned near the ribs 124. In this orientation, the trajectory 125 has an angle 127 from the horizontal plane 119 of about 25 degrees.

In another example seen in FIG. 6, the axis of the nozzle base opening 129 is at about 20 degrees to the horizontal plane 119 and the face of the nozzle housing 120 is at about 5 degrees to a line 130 that represents the nozzle axis. In this respect, the orientation shown in FIG. 6 causes the trajectory along line 121 from the nozzle 108 to have an angle 123 from the horizontal plane 119 of the sprinkler body of about 15 degrees. Similarly, the orientation shown in FIG. 7 causes the trajectory along line 125 from the nozzle 108 to have an angle 127 from the horizontal plane 119 of about 25 degrees.

Thus, the size and shape (i.e. the angles) of the coupling lip areas 120A from the axis of flow (line 156 in FIG. 11D which is ideally the same as the axis of the nozzle 108) and 120B determine the possible orientations of the nozzle 108 at different rotational positions by effectively "tilting" the nozzle 108. In other words, the outer end of the nozzle 108 is effectively increased or decreased in height by moving larger or smaller portions of the coupling lip under the nozzle 108. Further, in an alternate preferred embodiment, these coupling lip areas 120A and 120B can be modified (e.g. increased or decreased in height, increased or decreased in thickness, increased or decreased angles of lip surfaces, etc.) to achieve a variety of desired orientations of nozzle 108 through varying amounts of bias angle or nozzle opening angle.

Figure 9:
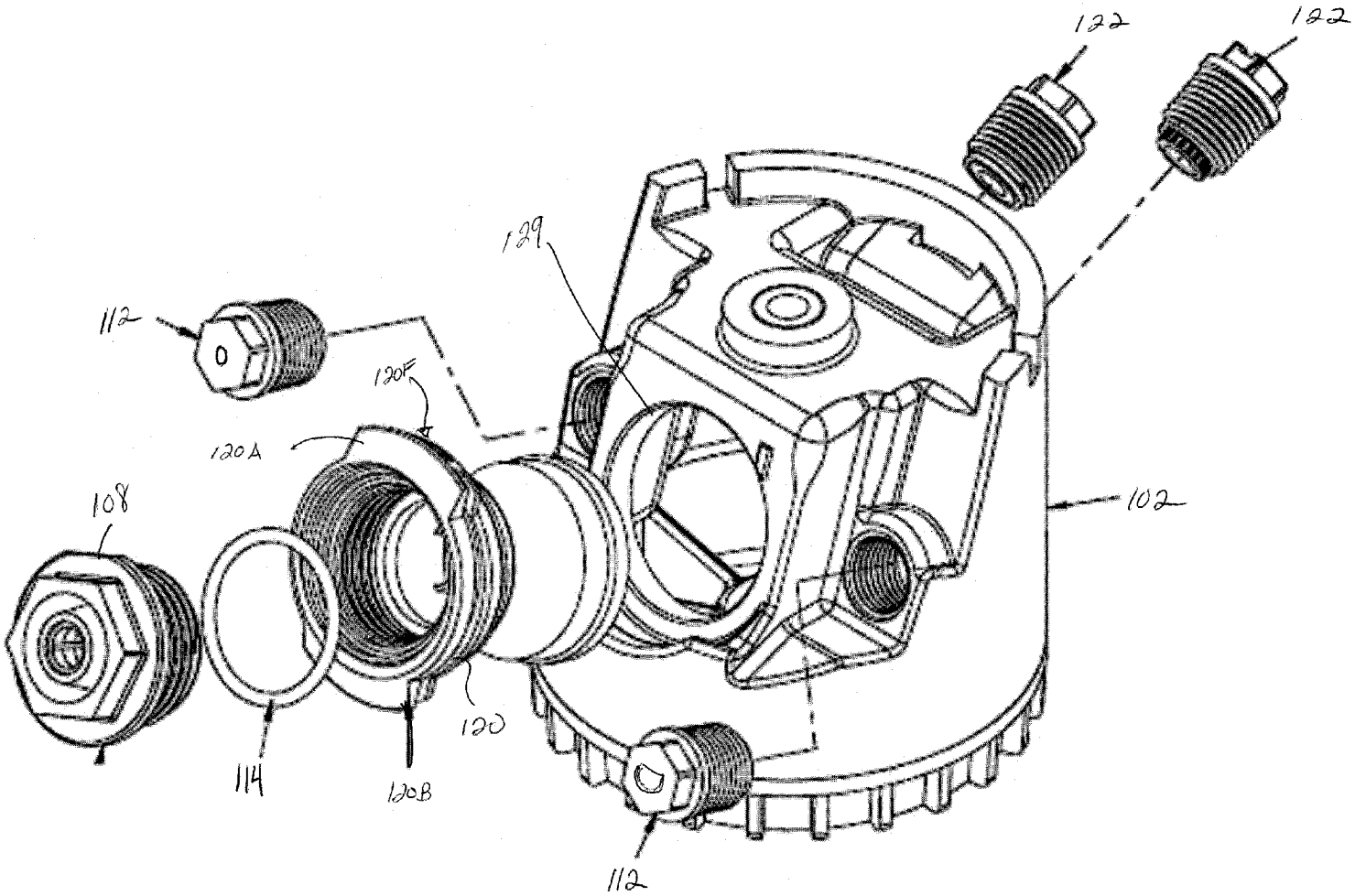
FIG. 9 illustrates an exploded perspective view of the sprinkler of FIG. 1.

The nozzle housing 120 could alternatively be described as having a central passage with an axis that is different than the axis of an opening 129 that receives the nozzle housing 120 (best seen in FIG. 9). For example, FIG. 6 illustrates a line 130 that represents the axis of the body of the nozzle housing 120 and a line 121 that represents the axis of the opening 129 on the nozzle base 120 which receives the nozzle housing 120.

If the opening 129 on the nozzle base 102 had the same axis as that of the body of the nozzle housing 120, then rotating the nozzle housing 120 within opening 129 would not produce a change in angular orientation or trajectory of the nozzle 108. However, the axis represented by line 121 is different from axis represented by line 130. Thus, rotating the nozzle housing 120 within the opening 129 changes the angle of the axis represented by line 121.

Figure 8:
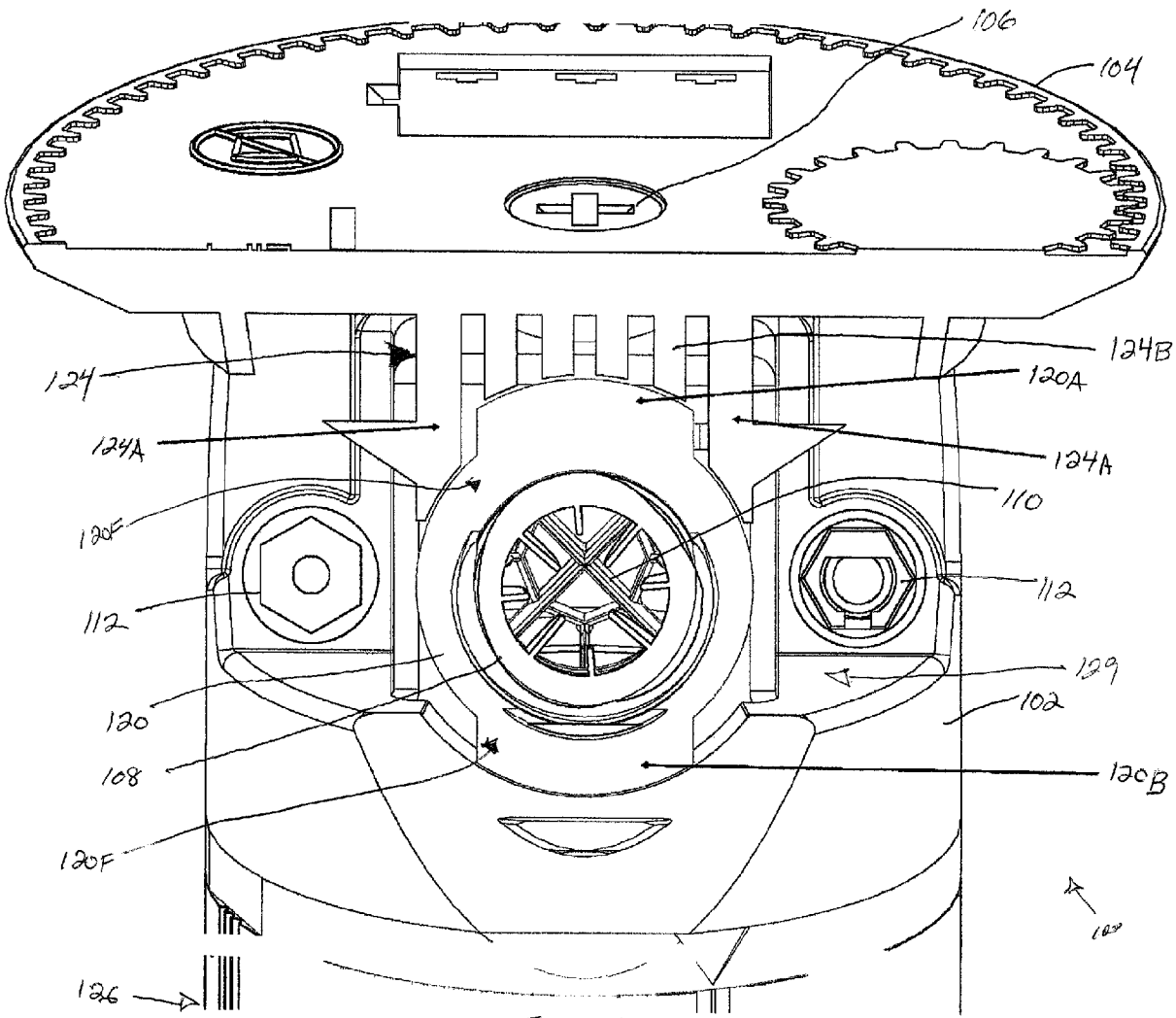
FIG. 8 illustrates a section front view of the sprinkler of FIG. 1.

As seen best in FIG. 8, the rotational orientation of the nozzle housing 120 is locked by side ribs 124A and top ribs 124B, which surround one of the coupling lip areas (e.g. first coupling lip area 120A as seen in FIG. 8). The side ribs 124A are positioned at least partially within the rotational path of the coupling lip area 120A or 120B on top of the nozzle housing 120 (i.e. on each side of the coupling lip area 120A or 120B so as to block rotation). Preferably, these ribs 124 are either coupled to or molded from the sprinkler cap 104 and can be configured in any shape that prevents rotation of the nozzle housing 120. By locking the nozzle housing 120 with the sprinkler cap 104 the nozzle housing 120 is prevented from rotating when the nozzle 108 is unscrewed and removed from the sprinkler 100. In this respect, replacing the nozzle 108 will not change the trajectory of the replacement nozzle from that of the original nozzle 108.

Since the nozzle housing 120 is prevented from rotation by the ribs 124 of the sprinkler cap 104, the user must remove the retaining screw 106 and sprinkler cap 104 before attempting to adjust the orientation of the nozzle 108. Once removed, the nozzle housing 120 can be rotated to any position which allows the ribs 124 to be positioned around and lock against the coupling lip areas 120A and 120B.

In the present embodiment, there are only two positions in which the ribs 124 can lock in place. The first is seen in FIG. 8 where the first coupling lip area 120A is located at a top position and the second coupling lip area 120B is located at a bottom position. The second position is the opposite of the first where the first coupling lip area 120A is located at the bottom position and the second coupling lip area 120B is located at the top position. However, the sprinkler 100 can be configured to allow multiple rotational positions and therefore multiple trajectories.

Figure 12:
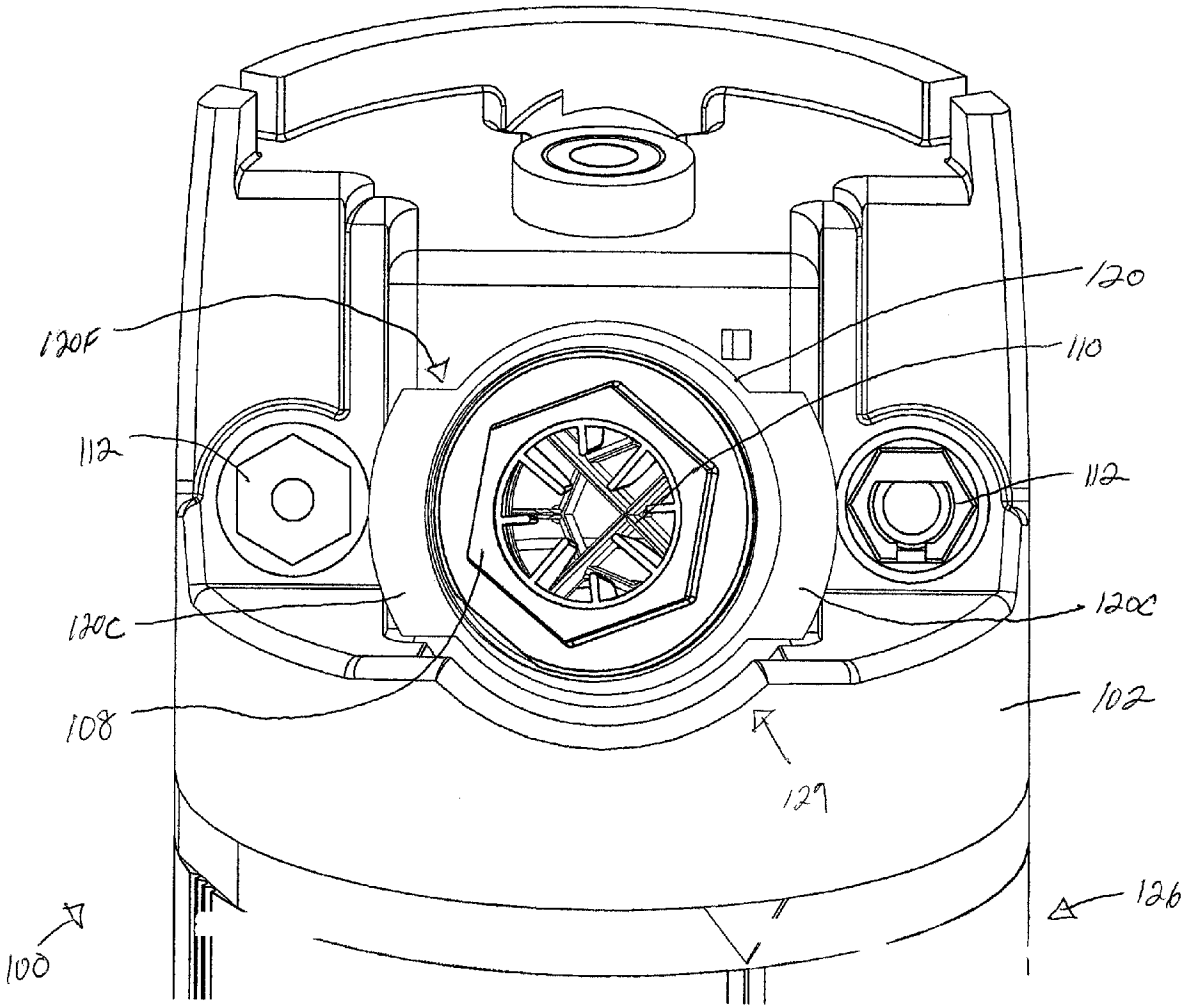
FIG. 12 illustrates a perspective view of a sprinkler according to the present invention.

For example, an alternate preferred embodiment seen in FIG. 12 may not include the ribs 124, allowing the nozzle housing 120 to freely rotate, even when the sprinkler cap 104 is coupled to the nozzle base 102. Additionally, the coupling lip areas 120C may have a relatively consistent and even height around the nozzle housing 120 than the previously described embodiments to further allow free rotation of the nozzle housing 120. In this respect, the nozzle housing 120, and therefore the nozzle 108, can be rotated within the nozzle base 102 to achieve any vertical angle between the predetermined minimum and maximum (i.e. the coupling lip areas 120A and 120B at either a top position or a bottom position), relying on variations in thickness and in the angles of outer surfaces 120G and 120H.

In another embodiment, the ribs 124 may be separate from the sprinkler cap 104 and further can be moved from a "locked" position restricting the rotational movement of the nozzle housing 120 to an "unlocked" position allowing the rotational movement of the nozzle housing 120. Additionally, the ribs 124 may be moved between these two positions from the top of the sprinkler cap 104, without the need to remove the sprinkler cap 104. For example, the ribs 124 may be a separate piece that can be inserted or removed from an aperture in the sprinkler cap 104.

In another alternate preferred embodiment, the nozzle housing 120 may have a threading that engages a similar threading within the nozzle base 102. This nozzle base threading follows an overall curved path, allowing the nozzle housing 120 to increase or decrease in angular position, depending on the direction the nozzle housing 120 is rotated. For example, this thread pitch may be sized and shaped to achieve similar angles as disclosed for other embodiments described in this application.

Further, the nozzle housing 120 may utilize a variety of different techniques or combinations of techniques to change the orientation angle of the nozzle 108. For example, varying the height of the coupling lip areas 120A and 120B, varying the thickness of the coupling lip areas 120A and 120B, changing the shape of the coupling lip areas 120A and 120B, including an offset axis angle between the body and flow passage of the nozzle housing 120, or with similar techniques previously described in this application.

It should be understood that although the elements of this application have been described in terms of distinct elements, many of these elements can be either combined or separated without departing from the present invention. For example, the nozzle 108 and the nozzle housing 120 may be a single unitary element. In another example, the ribs 124 may be elements separate from the sprinkler cap 104.

Although the invention has been described in terms of particular embodiments and applications, one of ordinary skill in the art, in light of this teaching, can generate additional embodiments and modifications without departing from the spirit of or exceeding the scope of the claimed invention. Accordingly, it is to be understood that the drawings and descriptions herein are proffered by way of example to facilitate comprehension of the invention and should not be construed to limit the scope thereof.

What is claimed is:

1. A sprinkler for distributing water from a source over an area of terrain comprising:

a housing having a housing inlet connected by a housing passage to a housing outlet; said housing inlet connectable to a water supply system;

a nozzle assembly having a generally tubular shape, a nozzle assembly passage and a nozzle assembly outlet through which a stream of water is ejected from said sprinkler;

an outer surface of said nozzle assembly engaging with an inner surface of said housing passage;

said nozzle assembly rotatable on an axis of rotation to increase or decrease a vertical trajectory of said stream of water ejected from said sprinkler; said axis of rotation extending substantially through said nozzle assembly outlet, said nozzle assembly passage and said housing outlet.

2. The sprinkler of claim 1, further comprising a sprinkler top removably coupled to said housing, said sprinkler top including a locking member engagable with said outer surface of said nozzle assembly so as to prevent rotation of said nozzle assembly.

3. The sprinkler of claim 2, wherein said locking member includes a rib positioned adjacent to said nozzle assembly when said sprinkler top is coupled to said housing.

4. The sprinkler of claim 1, wherein said nozzle assembly has a first angle of orientation at a first rotational relative to said housing and a second angle of orientation at a second rotational position relative to said housing.

5. The sprinkler of claim 4, wherein said first angle of orientation is about 12.5 degrees from a horizontal.

6. The sprinkler of claim 5, wherein said first and second angles are symmetrically selectable about an axis of an exit port of said nozzle housing.

7. The sprinkler of claim 1, wherein said outer surface of said nozzle assembly comprises a circumferential region having a first thickness along a first portion of said circumferential region and a second thickness along a second portion of said circumferential region; wherein orientation of said first thickness and said second thickness relative to said inner surface of said housing passage increases or decreases said vertical trajectory of said stream of water ejected from said sprinkler.

8. An irrigation sprinkler comprising:

a sprinkler body having an inlet and an outlet;

a nozzle rotatably disposed at said outlet;

said nozzle having a nozzle passage therethrough, an outer nozzle surface, and a nozzle opening creating an exit trajectory for escaping water; and, wherein said nozzle is rotatable on an axis of rotation for thereby changing said exit trajectory of said nozzle; said axis of rotation passing substantially through said nozzle passage and said opening creating said exit trajectory for escaping water.

9. The irrigation sprinkler of claim 8, further comprising a sprinkler top removably connected to a top of said sprinkler body, said sprinkler top including a locking member engagable with said nozzle to prevent rotation of said nozzle.

10. The irrigation sprinkler of claim 9, wherein said locking member includes a rib positioned adjacent to said nozzle when said sprinkler top is connected to said top of said sprinkler body.

11. The irrigation sprinkler of claim 8, wherein a said nozzle passage of said nozzle includes a first trajectory angle at a first rotational position relative to said sprinkler body and a second trajectory angle at a second rotational position relative to said sprinkler body.

12. The irrigation sprinkler of claim 8, further comprising a lip disposed at least partially disposed around said outer nozzle surface; said lip having a variable thickness for repositioning said nozzle to said first trajectory angle or said second trajectory angle when rotated.

13. A sprinkler for distributing water from a source over an area of terrain comprising:

A sprinkler housing having a sprinkler inlet opening and a sprinkler outlet opening; and, a nozzle member having a nozzle passage therethrough and a nozzle exit aperture; said nozzle member rotatably disposed within said sprinkler housing at said sprinkler outlet opening;

wherein said nozzle member is rotatable on an axis of rotation for changing a vertical orientation of said nozzle member relative to said sprinkler housing; said axis of rotation substantially extending through said nozzle exit aperture and said sprinkler outlet opening.

14. The sprinkler of claim 13, wherein an outer surface of said nozzle member comprises a lip.

15. The sprinkler of claim 14, wherein said lip has mating surfaces that are less than 90 degrees relative to an axis of flow of said nozzle member.

16. The sprinkler of claim 14, wherein said lip includes a first region having a first thickness and a second region having a second thickness.

17. The sprinkler of claim 13, further comprising a locking member disposed on said housing to selectively prevent said nozzle member housing from rotation relative to said sprinkler outlet opening.

18. A method of adjusting a watering stream trajectory of an irrigation sprinkler comprising:

providing a sprinkler body having a nozzle member rotatably disposed on said sprinkler body;

rotating said nozzle member on an axis of rotation substantially passing through a water inlet aperture of said nozzle member and through a water outlet aperture of said nozzle member; whereby said rotating of said nozzle member increases or decreases a vertical trajectory angle for water ejected from said irrigation sprinkler.

19. The method of claim 18, wherein said rotating of said nozzle member is preceded by disengaging a locking member to allow rotation of said nozzle member.

20. The method of claim 18, further comprising engaging a locking member to prevent rotation of said nozzle member.

* * * * *